US007871241B2

(12) United States Patent
Bourgeois et al.

(10) Patent No.: US 7,871,241 B2
(45) Date of Patent: Jan. 18, 2011

(54) SELF-MONITORING SYSTEM FOR EVALUATING AND CONTROLLING ADJUSTMENT REQUIREMENTS OF LEAKAGE RESTRICTING DEVICES IN ROTODYNAMIC PUMPS

(75) Inventors: Ronald J. Bourgeois, Sun Prairie, WI (US); Randy J. Kosmicki, Edgerton, WI (US); Jeffrey C. Vian, Windsor, WI (US); Tyler M. Erlandson, Madison, WI (US); Michael L. Viken, Cottage Grove, WI (US)

(73) Assignee: Weir Slurry Group, Inc., Madison, WI (US)

( * ) Notice: Subject to any disclaimer, the term of this patent is extended or adjusted under 35 U.S.C. 154(b) by 0 days.

(21) Appl. No.: 12/353,735

(22) Filed: Jan. 14, 2009

(65) Prior Publication Data

US 2009/0180866 A1 Jul. 16, 2009

Related U.S. Application Data

(60) Provisional application No. 61/011,100, filed on Jan. 15, 2008.

(51) Int. Cl.
*F04D 29/08* (2006.01)

(52) U.S. Cl. ..... 415/128; 415/168.1; 415/172.1

(58) Field of Classification Search ..... 415/128
See application file for complete search history.

(56) References Cited

U.S. PATENT DOCUMENTS

| | | | | |
|---|---|---|---|---|
| 1,878,429 | A * | 9/1932 | Staup | 415/128 |
| 4,527,948 | A | 7/1985 | Addie | |
| 4,651,091 | A | 3/1987 | Chambers et al. | |
| 5,427,498 | A * | 6/1995 | Lehe et al. | 415/58.2 |
| 5,454,270 | A | 10/1995 | Brown et al. | |
| 5,941,536 | A | 8/1999 | Hill | |
| 5,971,704 | A | 10/1999 | Blattmann | |
| 6,599,086 | B2 | 7/2003 | Soja | |
| 6,676,382 | B2 * | 1/2004 | Leighton et al. | 417/40 |
| 6,682,298 | B2 * | 1/2004 | Demontmorency | 415/133 |
| 6,739,829 | B2 | 5/2004 | Addie | |
| 6,782,344 | B2 | 8/2004 | Ito et al. | |
| 7,160,490 | B2 | 1/2007 | Hofmann | |
| 2003/0012642 | A1 | 1/2003 | Soja | |
| 2004/0136825 | A1 | 7/2004 | Addie et al. | |

FOREIGN PATENT DOCUMENTS

| | | |
|---|---|---|
| JP | 6-272698 | 9/1994 |
| JP | 06272698 A * | 9/1994 |

OTHER PUBLICATIONS

JP 06272698 A Machine English Translation. Accessed from JPO website Apr. 12, 2010.*

* cited by examiner

*Primary Examiner*—Richard Edgar
(74) *Attorney, Agent, or Firm*—Morriss O'Bryant Compagni

(57) ABSTRACT

A self-monitoring adjustment system is provided for evaluating and effecting adjustment of the leakage restricting mechanism between the rotating and non-rotating elements of a rotodynamic pump to restrict leakage and to establish desired gap dimensions between the rotating and non-rotating elements of the pump. The adjustment system is structured to be self-monitoring for determination of when an adjustment of the leakage restricting mechanism is warranted by the conditions of the pump, and is structured with adjusting mechanisms that are self-adjusting responsive to the monitored conditions of the pump, though manual adjustment is also enabled.

22 Claims, 7 Drawing Sheets

SELF-MONITORING SYSTEM FOR EVALUATING AND CONTROLLING ADJUSTMENT REQUIREMENTS OF LEAKAGE RESTRICTING DEVICES IN ROTODYNAMIC PUMPS

BACKGROUND OF THE INVENTION

1. Field of the Invention

This invention relates to rotodynamic pumps, and specifically relates to means for controlling and automating the adjustment devices for restricting fluid recirculation and reducing wear between rotating and non-rotating fluid processing elements of rotodynamic pumps, especially those pumps that are suitable for handling slurries and those pumps that are, or can be, configured with adjustable wear components designed as leakage restricting devices.

2. Description of Related Art

Rotodynamic pumps, such as centrifugal pumps, are commonly known and used for pumping fluids in many types of industries and for many applications. Such pumps generally comprise an impeller (rotating element) housed within a pump casing (non-rotating element) having a fluid inlet and fluid outlet, or discharge. The impeller is typically driven by a motor external to the casing. The impeller is positioned within the casing so that fluid entering the inlet of the casing is delivered to the center, or eye, of the impeller. Rotation of the impeller acts on the fluid primarily by the dynamic action of the impeller vanes which, combined with centrifugal force, move the fluid to the peripheral regions of the casing for discharge from the outlet.

The dynamic action of the vanes, combined with centrifugal forces resulting from impeller rotation, produces pressure gradients within the pump. An area of lower pressure is created nearer the eye of the impeller and an area of higher pressure results at the outer diameter of the impeller and in the volute portion of the casing. An area of pressure change, from higher to lower pressure exists in the radially extending gap located between the rotating and non-rotating components. The pressure differential within the pump leads to fluid recirculation through the radial gap, between areas of high and low pressure. Such fluid recirculation, typically characterized as leakage, results in a consequential loss of pump performance and a dramatic increase in wear when there is a presence of solid particles in the fluid.

Therefore, pumps are structured with various leakage restricting devices, both on the drive side of the impeller to prevent or restrict external leakage, and on the inlet or suction side of the impeller to prevent or restrict internal recirculating leakage. Pump leakage-restricting or sealing mechanisms have been developed where a side liner, or wear plate, is placed in axial juxtaposition to the impeller of the pump. The side liners, usually corresponding to a suction side and a drive side of the pump, are positioned to abut the pump casing and, in some configurations, may be bolted to the pump casing. In other configurations, the side liners are mounted near the pump casing so that the axial position of the side liners relative to the impeller is adjustable.

The side liners may be metal, ceramic or elastomer material, or a combination of materials, and provide a simplified construction for repair or maintenance of the pump. Constructing the side liners with an elastomer seal to allow adjustability of a complete suction side or drive side has proven beneficial to extend the wear life of the liners. Additionally, a side liner provides a beneficial extension of the service life of the suction side seal face in heavy duty slurry applications versus adjusting only a seal wear ring. (Hill U.S. Pat. No. 5,941,536).

Radially-extending gaps, or tapered gaps that are substantially radially-extending, between the rotating and non-rotating members are much less prone to entrapment of solids and are commonly employed in slurry pumps. Nevertheless, leakage restricting arrangements are widely used in the radial gap between the rotating and non-rotating elements, whether on the drive side or suction side, to further restrict leakage and solids entrapment. For example, US Published Application No. 2004/0136825 to Addie, et al. discloses a fixed projection on either the pump casing or on the impeller to provide a leakage restricting arrangement between the impeller and the pump casing. These restriction configurations may suffer from declining performance in service if an adjustment means is not present to compensate for wear. Seal rings, or wear rings, which generally extend between the rotating and non-rotating elements are also used as leakage restricting devices.

Methods of adjusting seal rings and side liners are known and employed in rotodynamic pumps. For example, U.S. Pat. No. 4,527,948 to Addie, et al., describes a means of manually adjusting a seal to contact the impeller. U.S. Pat. No. 5,971,704 to Blattmann is similar to the '948 patent in that it discloses the use of threaded pusher bolts to manually adjust a small seal ring toward the impeller to a set clearance. These sealing arrangements force a wear ring towards the surface of the impeller. Such adjustment systems rely on manual adjustments of the mechanism. Following the manual adjustment of the seal, a period of time exists where there is a forcible contact between the rotating and non-rotating elements, but as the elements wear, a clearance between the two components develops. Uncontrolled or unmonitored clearances between the components allow leakage, which accelerates wear. Additionally, the clearance between the rotating and non-rotating elements will become progressively larger until a further adjustment is made.

U.S. Pat. No. 6,739,829 to Addie discloses an adjustable, floating ring element positioned between the impeller and the pump casing, which is also configured with means for receiving and distributing cooling and flushing fluid into the gap between the impeller and pump casing. The leakage restricting ring relies on water to flush the leakage restricting mechanism and provide the force to maintain its proximity to the impeller. The required flush system must be able to provide a consistent supply of clean liquid to the seal mechanism at a pressure which is not high enough to cause damage to the seal, but is sufficiently high enough to overcome internal pressures in the pump. The sufficiency of the pressure required in the flush system is dependent upon the application and the pump.

U.S. Pat. No. 6,599,086 to Soja describes an adjustable wear plate for a rotodynamic pump. The disclosed wear plate also uses a manual adjustment mechanism to position a complete side liner.

Prior adjustment mechanisms for sealing arrangements and side liners have heretofore been specifically directed to providing a manual means of adjustment. As a result, such arrangements may still be vulnerable to over adjustment and/or lack of sufficient adjustment, which may lead to undesirable fluid recirculation, or leakage, and wear between rotating and stationary elements of the pump. Moreover, flush water is not always available or practical for a given application. Further, the relative position of the sealing elements or leakage restricting mechanisms may not be accurately controlled by manual adjustment means due to variables of the application.

Thus, it would be advantageous in the art to provide a means for effecting automatic adjustment of the leakage restricting mechanism associated with the radial gap between rotating and non-rotating elements of the pump to control leakage and wear, thereby improving the life of the elements and performance of the pump. It would also be advantageous to provide a monitoring mechanism whereby the adjustment can be made automatically responsive to a detected need to effect an adjustment to the preferred gap between the rotating and non-rotating elements. It would also be advantageous to provide in a rotodynamic pump a sensor device that indicates one or more conditions within the pump so that manual adjustment can be effected.

BRIEF SUMMARY OF THE INVENTION

In accordance with the present invention, an automatic adjustment system is provided for effecting adjustment of the leakage restricting mechanism between the rotating and non-rotating elements of the pump to restrict leakage and to establish desired gap dimensions between the rotating and non-rotating elements of a pump. The automatic adjustment system is structured to be self-monitoring for determination of when an adjustment of the leakage restricting mechanism is warranted by the conditions of the pump, and is structured with adjusting mechanisms that may be self-adjusting responsive to the monitored conditions of the pump. The automatic adjustment system is described herein with respect to use in a centrifugal pump of the slurry type primarily to reduce wear, but may be adapted for use in any rotodynamic pump with a resulting increase in pump performance.

In a further embodiment of the invention, a sensor or monitoring device is provided in, or in proximity to, the pump so that one or more conditions of the pump can be monitored by the device, and an indicator or other alerting device will advise of the condition so that a manual adjustment can be made of the adjusting mechanisms of the pump to provide a preferred gap between the rotating and non-rotating elements. While this embodiment does not provide automatic means for adjusting the non-rotating element, it is nonetheless within the purview of the invention to provide detection and or monitoring devices for allowing manual adjustment.

As used herein, "rotating element" refers to the impeller or a similar structure, such as a rotor, that is driven and typically housed within a casing of the pump. As used herein, "non-rotating element" refers to any stationary structure or structures that are positioned adjacent the rotating element and which, in juxtaposition with the rotating element, produce a gap therebetween through which fluid recirculation, or leakage, typically occurs due to pressure differentials. The non-rotating element may, most typically, be a leakage restricting mechanism, a side liner or a portion of the pump casing.

The automatic adjustment system of the present invention is generally comprised of at least one sensor or detection mechanism, at least one adjustment device and a control system in communication with both the sensor or detection mechanism and the adjustment device for effecting appropriate adjustment of the leakage restricting mechanism to provide more effective resistance to fluid recirculation and wear.

The sensor or detection mechanism, of which there is at least one, is positioned in proximity to an element of the pump to monitor one or more conditions that would indicate a necessity for making an adjustment of the gap existing between the rotating and non-rotating elements. The sensor or detection device may be positioned within the pump or outside of the pump.

The sensor or detecting mechanism may be any suitable device that is capable of determining the contact between the rotating and non-rotating elements and/or that is capable of determining one or more conditions that indicate the need to effect an adjustment of the gap between the rotating and non-rotating elements. Such conditions may include, but are not limited to, the measurable dimension of distance existing between the rotating and non-rotating elements, the existence of pressure or pressure differentials at or near the gap, the amount of force needed to rotate the rotating element, or the amount of force required to actuate the adjustment.

Examples of sensor or detecting mechanisms (the terms being used interchangeably herein) are a proximity sensor to determine the dimensions of the gap between the rotating and non-rotating elements, a vibration sensor capable of detecting an amount of change in vibration levels which indicates contact between the rotating and non-rotating elements, a force sensor capable of determining that a certain change in the amount of force is required to make the adjustment between rotating and non-rotating elements and a torque sensor capable of detecting an amount of change in the torque of the rotating element which indicates a condition of contact between the rotating and non-rotating elements. Another suitable sensor or detecting mechanism would be one that detects an increase in the amps being drawn by the drive motor for the rotating element, which indicates contact between the rotating and non-rotating elements.

The adjustment device of the invention, of which there is at least one and most typically a plurality of adjustment devices, is any structure that is capable of effecting a movement of the non-rotating element relative to the rotating element in a manner that adjusts the gap existing therebetween and through which fluid recirculation, or leakage, occurs. An exemplary type of adjustment device is one which comprises a member, such as a threaded rod, having a first end that is in contact with the movable non-rotating element and a second end which is structured with an actuation mechanism. Operation of the actuation mechanism causes the threaded rod to move against the non-rotating element to effect movement of the non-rotating element in the direction of the rotating element. Any type or configuration of an adjustment device can be employed in the invention which is capable of carrying out the required movement of the non-rotating element responsive to a signaled activation of the adjustment device.

The actuation mechanism of the adjustment device may be any manner or type of device that causes movement of the adjustment device against the non-rotating element. For example, the actuation mechanism may be hydraulic, pneumatic or some other mechanical instrumentality.

The actuation mechanism of the adjustment device is further structured to communicate with a control system that signals the actuation mechanism to operate responsive to detected conditions in or of the pump. In this regard, existing adjustment devices on existing pumps can be retrofitted with an actuation device, and sensor mechanisms can be positioned with respect to the pump, and to the control system, to equip existing pumps in the field with the automatic adjustment system of the present invention.

The control system, as noted, is in communication with both the sensor device or devices and with the actuation mechanism of each adjustment device. The control system is of a type that can receive data from the detection or sensor device, process that data, and signal the actuation mechanism of each adjustment device to operate in response to the detection of a condition within the pump. Thus, the control system may have a central database for enabling these steps.

Further, the database of the control system may be enabled with appropriate software and hardware for determining appropriate intervals at which adjustments should be made to provide predictive adjustments consistent with the conditions or operation of a given pump. The control system may even have storage capacity which enables the determination of actual or potential pre-operation conditions that enable an initial setting of the distance between the rotating and non-rotating elements. Such data would serve as a baseline from which the relative position of the rotating and non-rotating elements may be established, followed by appropriate adjustments determined by monitoring of the pump conditions by the sensor devices.

The control system may also be programmed with optimum clearance or gap dimension data such that if contact is detected between the rotating and non-rotating elements, the actuation mechanism can be signaled to effect a reverse movement, or "backing off," of the non-rotating element relative to the rotating element.

The control system may also have the capacity to store previous adjustment data and time to determine a wear rate of the components. The calculated wear rate may then be used to determine a predicted wear rate and initiate an adjustment sequence to maintain a continuous or nearly continuous relative position between the rotating and non-rotating components without contact. Periodically, a contact sequence may be initiated which would allow for updating of the wear rate. Alternatively a signature from a position sensor or sensors may be determined which correlates to the relative position of the adjustable elements. This signature will then be used to determine and predict the above mentioned wear rate.

BRIEF DESCRIPTION OF THE SEVERAL VIEWS OF THE DRAWINGS

In the drawings, which currently illustrate the best mode for carrying out the invention.

DETAILED DESCRIPTION OF THE INVENTION

Figure 1:
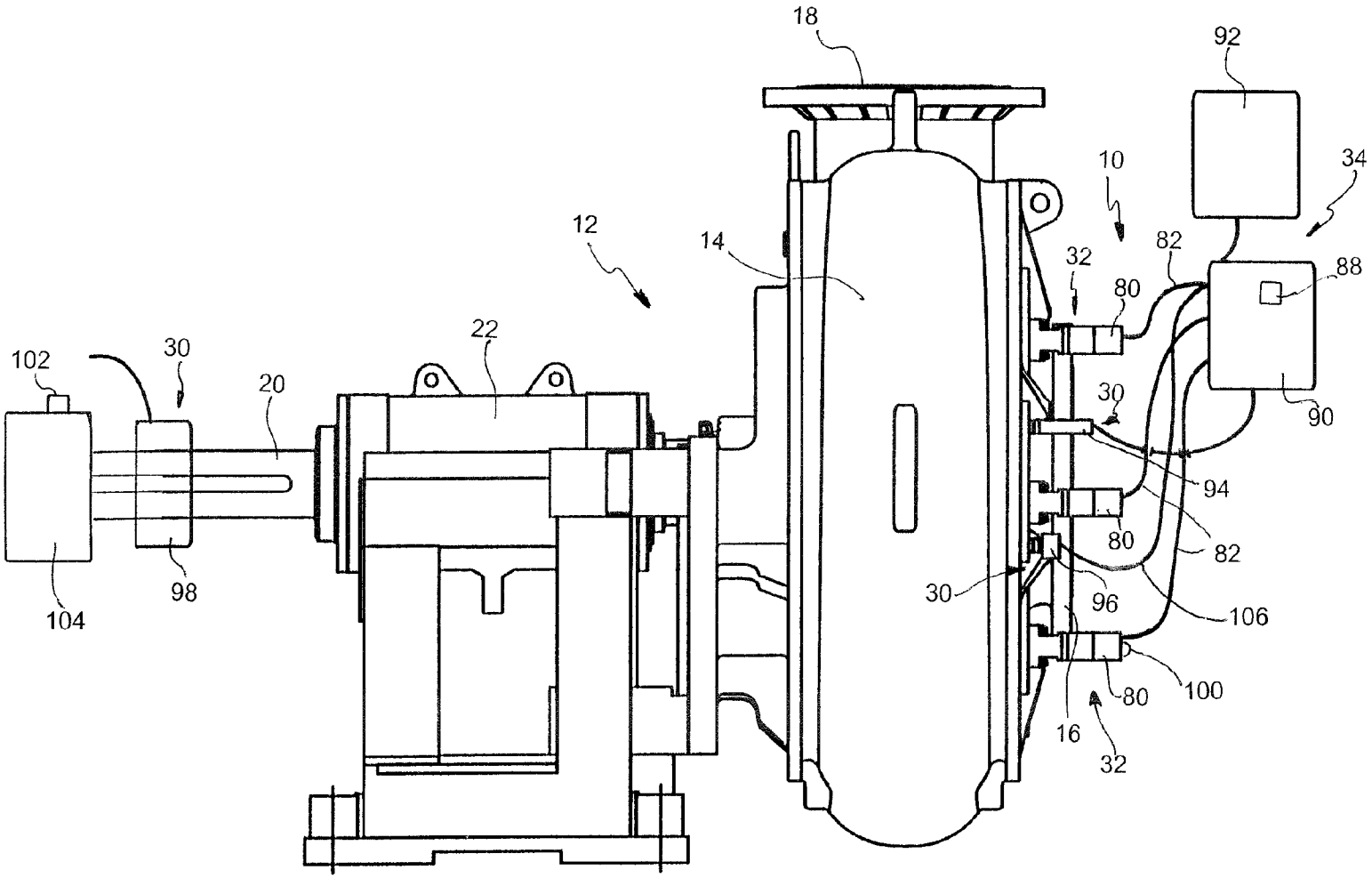
FIG. 1 is a side view in elevation of a centrifugal pump schematically showing the fundamental external components of the present invention.

In the drawings, where the same or similar elements are indicated by the same reference numerals, FIG. 1 illustrates an automatic adjustment system 10 encompassed by the present invention installed in a rotodynamic pump 12. The rotodynamic pump 12 generally comprises a pump casing 14 having a fluid inlet 16 and a fluid outlet 18 for discharge. The pump 12 further includes a drive mechanism 20 for driving the rotating elements of the pump, and the drive mechanism 20 is positioned through a bearing assembly 22 to which the pump casing 14 is secured in known manner.

The automatic adjustment system 10 of the present invention is generally comprised of at least one sensor or detection mechanism 30 (of which a plurality of various sensor or detection mechanisms are shown for illustrative purposes), at least one adjustment device 32 and a control system 34. The present invention may preferably comprise a plurality of adjustment devices 32 which, as shown more clearly in FIG. 2, may, for example, be positioned to encircle the fluid inlet 16 of the pump 12. Each of the adjustment devices 32 is illustrated as being wired to the control system 34, as will be explained further below.

Figure 3:
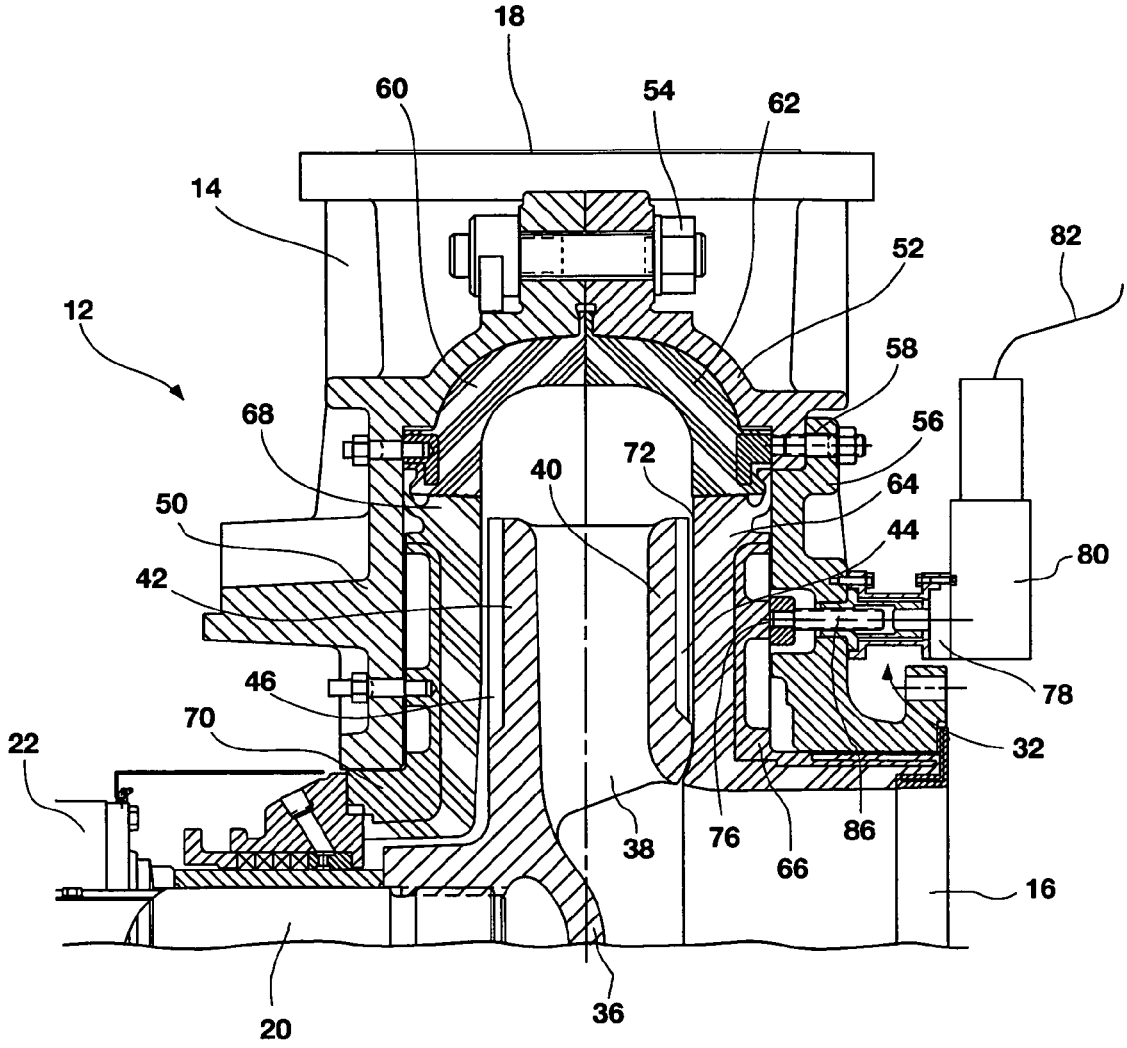
FIG. 3 is an enlarged view in cross section of the wet end of a slurry pump illustrating the internal elements of the present invention.

Referring to FIG. 3, which illustrates the internal aspects of the pump 12, it can be seen that in conventional manner, an impeller 36 is positioned within the pump casing 14 of the pump 12 and is connected to the drive mechanism 20 for rotation within the pump casing 14. The impeller 36 may be of any type or construction, but is shown here as having at least one vane 38 positioned between a front shroud 40 and a back shroud 42, corresponding to the suction side and drive side of the pump, respectively. The impeller 36 may, as here, have expelling vanes 44 positioned on the front shroud 40 and expelling vanes 46 positioned on the back shroud 42. Expelling vanes may not always be present, and the type or configuration of the impeller may vary widely with the application and type of pump.

The pump casing 14 of the pump 12 may vary widely in its structure and configuration. By way of example only, the illustrated pump 12 has a pump casing 14 that is comprised of a drive side casing 50 and separate front or suction side casing 52 which is secured to the drive side casing 50 by bolts 54. The suction side casing 52 is configured with a separate suction cover 56 which is secured to the suction side casing 52 by bolts 58. In the particular configuration shown, the pump casing 14 is further comprised of separate liner pieces, including a drive side casing liner 60 and a suction side casing liner 62 which are both designed as wear components. It is possible for the pump 12 to have a multiple piece drive side casing (e.g., a drive side cover (not shown) similar to the suction side casing 52 and cover 56).

In the pump configuration shown, the drive side casing liner 60 is positioned within the drive side casing 50 and is bolted into place. The suction side casing liner 62 is positioned within the suction side casing 52 and is bolted into place. A separate, non-rotating suction side liner 64 is positioned within the suction side casing liner 62 and is located adjacent the suction side of the impeller 36. Positioned adjacent the suction side liner 64 is a reinforcement plate 66. By virtue of its formation, the suction side liner 64 and reinforcement plate 66 may be collectively referred to as a suction side liner assembly, as described more fully in U.S. Pat. No. 5,591,536, the disclosure of which is incorporated herein by reference. Similar to the suction side, the pump 12 may be configured with a drive side liner 68 positioned adjacent the drive side of the impeller 36, and a reinforcement plate 70 may be positioned against the drive side liner 68 to form a drive side liner assembly.

An exemplary structure and positioning of the adjustment devices of the present invention will be described herein with respect to the suction side of the pump 12, which is inherently where the automatic adjustment system would be positioned. However, the automatic adjustment system of the invention may further comprise adjustment devices positioned on the drive side of the pump in connection with the drive side liner assembly in the same manner as described for the suction side of the pump.

It can be seen from FIG. 3 that the position of the suction side liner 64 adjacent the suction side of the impeller 36 forms a gap 72 through which fluid can recirculate, or leak, under various and previously described conditions. It is desirable to restrict such leakage by maintaining an appropriately close tolerance between the suction side liner 64 and the impeller 36. Thus, the suction side assembly is configured to be axially moveable in a direction toward the impeller to maintain an appropriate axial dimension of the gap 72 to restrict leakage and wear.

For that purpose, the present invention comprises adjustment devices 32 having one end 76 that is secured to the reinforcement plate 66 of the suction side liner assembly. The adjustment device 32 has a second end 78 which comprises an actuation mechanism 80.

Figure 2:
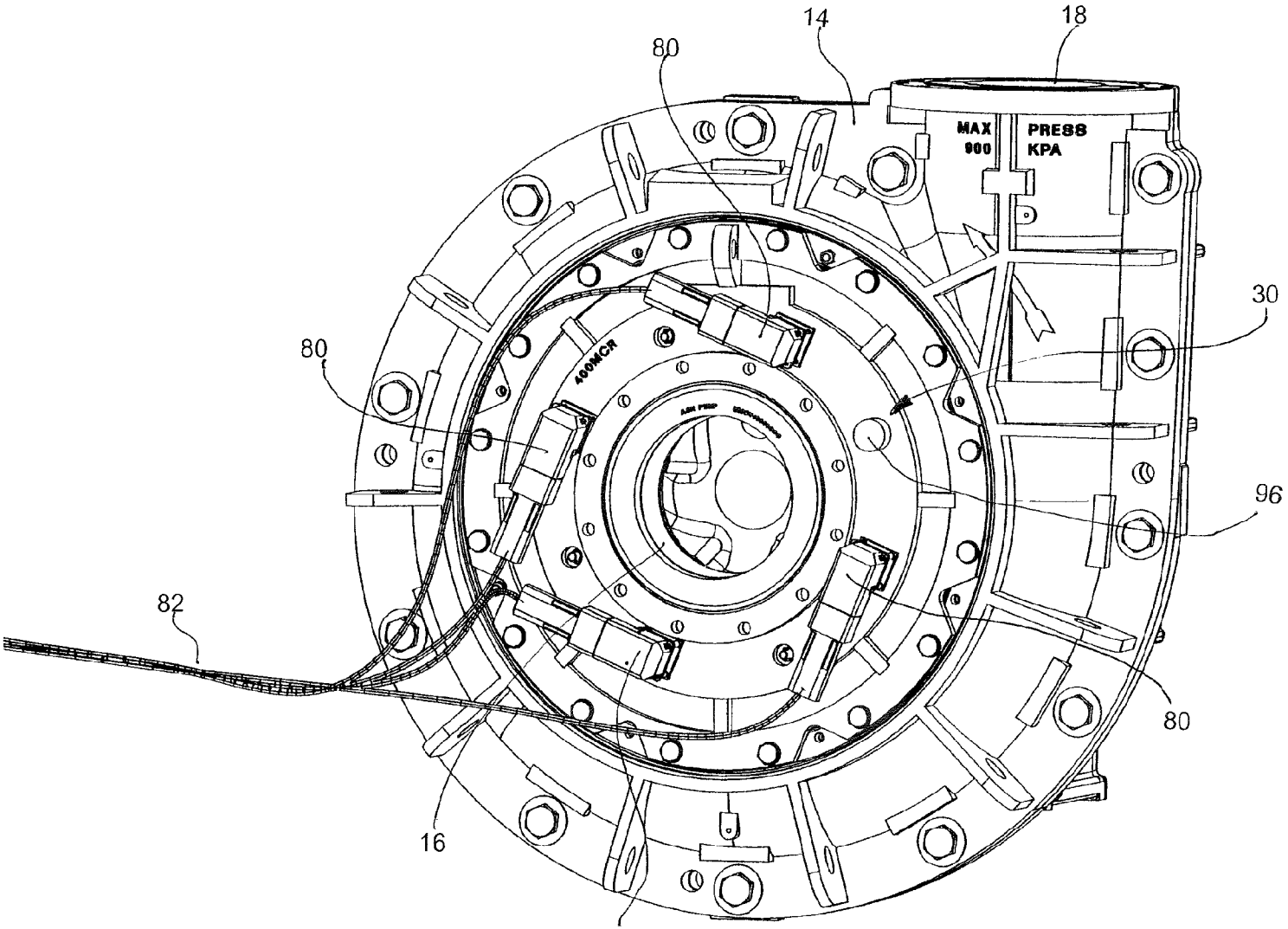
FIG. 2 is an isometric view of a centrifugal pump showing the inlet side of the pump and illustrating the placement of the actuating mechanism portion of a plurality of adjustment devices and various sensors.

The actuation mechanism 80 is, as shown in FIGS. 1, 2 and 3, in electrical communication with the control system 34 of the invention, such as by a wire 82 as shown here. The actuation mechanism 80 may be in wireless communication, however, with the control system 34. The adjustment device 32, as shown more clearly in FIG. 3, may comprise a rod 86 secured to the reinforcement plate 66, the rod 86 being movable in response to the activation of the actuation mechanism 80. The actuation mechanism 80 may be any suitable structure or device, such as a servo device, and may be electromechanically, hydraulically or pneumatically operated, or any combination of such means. That is, the powered actuation mechanism 80 may be any device which converts electrical or fluid power to a desired mechanical motion to effect movement of the adjustment device 32.

The actuation mechanism 80 of each adjustment device 32 is in communication with a central processing unit (CPU), shown schematically in FIG. 1 at 90, of the control system 34, which is capable of sending a signal to the adjustment devices 32 responsive to received information from at least one sensor mechanism 30. Thus, the CPU 90 is also in communication, wired or wireless, with the sensor mechanism 30 to collect data for processing. The control system 34 also includes data storage and processing capability, as suggested at 92 in FIG. 1 for calculating and storing information concerning optimal gap dimensions, adjustment intervals and monitoring protocols for wear in the leakage restricting mechanism, e.g., the suction side liner 64.

In an alternative embodiment of the invention, the sensor mechanisms 30 are in communication with the control system 34, such as the CPU 90, either by wired or wireless means, and send data to the control system 34. The control system 34 is structured with an alarm 88 or equivalent device that provides an indication of a condition of the pump which requires an adjustment to be made between the rotating and non-rotating elements of the pump. Responsive to the notice provided by the alarm 88, manual adjustment can be effected as described.

The sensor or detection mechanism 30 of the present invention may be any suitable device that can monitor and detect conditions in the pump, from which a determination can be made for activating adjustment of the suction side liner assembly, and/or signaling an adjustment sequence has eliminated the gap, either automatically or manually. FIGS. 1 and 2 illustrate in a single figure a variety of such sensor mechanisms 30. A first type of sensor mechanism 30 may be a linear displacement sensor 94 which is positioned through the pump casing and in proximity to the impeller 36 to detect linear, or axial, movement of the impeller 36 and suction side liner 64 relative to each other. The linear displacement sensor 94 can, therefore, detect whether the gap 72 between those elements is sufficiently large to warrant adjustment of the suction side liner 64, or that the gap is eliminated thus concluding the adjustment.

Figure 4:
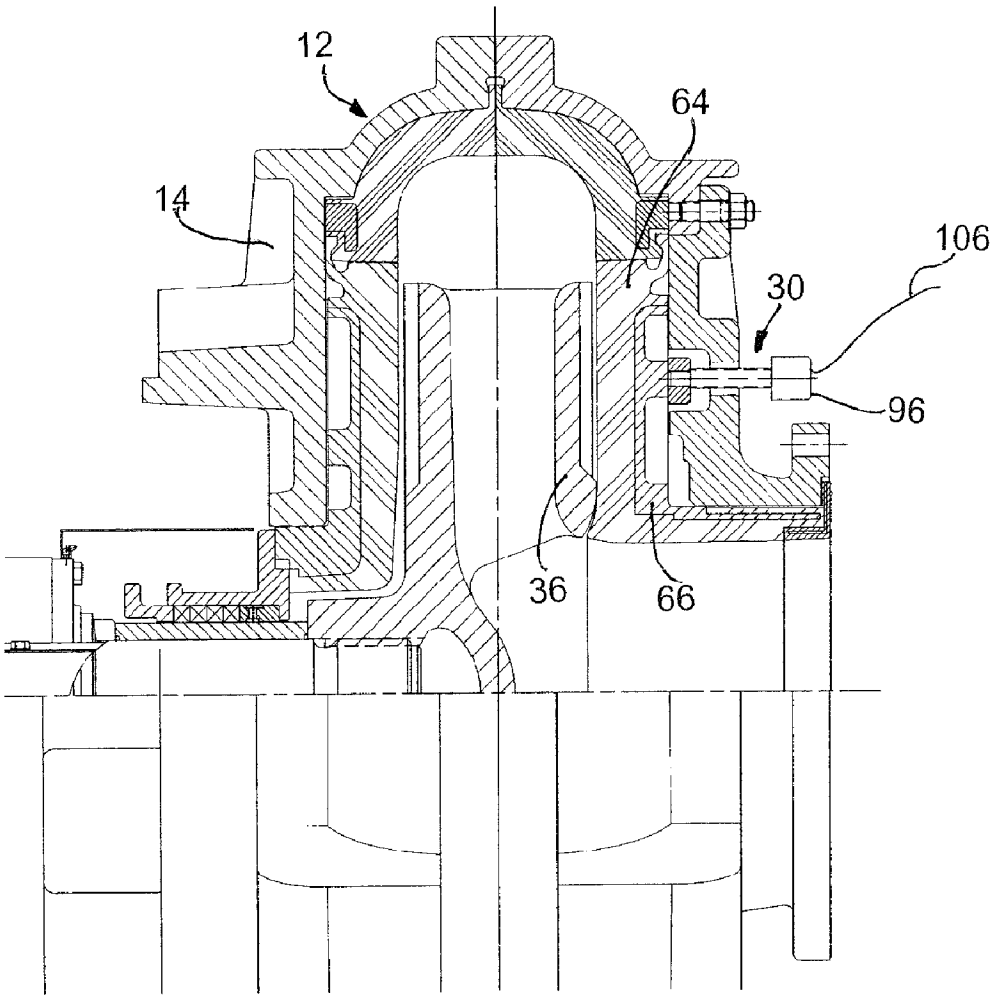
FIG. 4 is a partial view in cross section of a pump showing the positioning of the vibration sensor.

Another type of sensor mechanism 30 shown in FIGS. 1, 2 and 4 is a vibration sensor 96 which detects vibration levels of the pump or a pump component. Contact between the impeller 36 and the suction side liner 64 changes these vibration levels, thereby enabling the determination of whether those two elements are contacting each other. Depending on the design of the leakage restricting device, this information may initiate an adjustment sequence or may indicate than an adjustment sequence initiated by another factor has eliminated the gap. It can be seen from FIG. 4 that the vibration sensor 96 is positioned in close proximity to the reinforcement plate 66.

A third type of sensor mechanism 30 is shown in FIG. 1 as a torque sensor 98, which is positioned on the drive mechanism 20. The torque sensor 98 is capable of determining a change in the torque required to rotate the impeller 36, which in turn is indicative of whether contact is being made between the impeller 36 and the suction side liner 64 such that an adjustment is appropriate or that an adjustment sequence has eliminated the gap. Torque sensors 100 may also be positioned on or near the adjustment devices 32, as schematically represented in FIG. 1.

A fourth type of sensor mechanism 30 is schematically represented in FIG. 1 as an amp meter 102 or detector associated with the drive motor 104 of the pump. Detection of an increase in the amps required in the motor 104 can indicate contact between the rotating and non-rotating elements of the pump.

Any one or a combination of these, and any other suitable sensor mechanism or device, may be used to monitor and determine conditions of or within the pump that warrant adjustment of the non-rotating element (i.e., suction side liner) relative to the rotating element (i.e., the impeller) or indicate that an adjustment sequence has eliminated the gap.

The sensor or detection mechanism of the present invention, when employed in a mode for providing automatic adjustment of the adjustment device 32, is in electrical, mechanical or electromechanical communication with the control system 34. This may be accomplished, for example, by providing a wire 106 between the sensor mechanism 30 (e.g., vibration sensor 96) and the control system 34.

Figure 5:
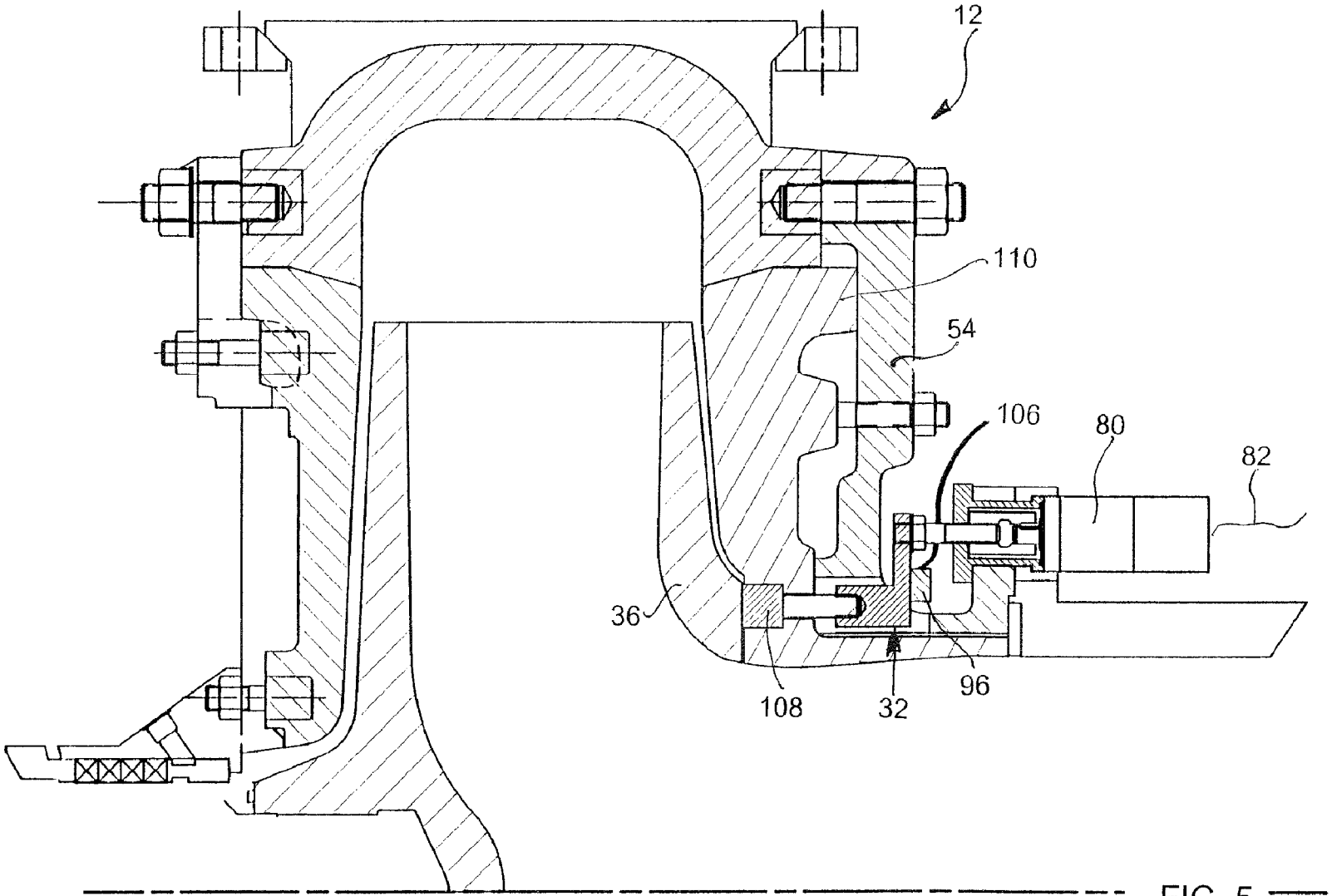
FIG. 5 is a partial view in cross section of a pump showing an alternative embodiment of the invention for use with an adjustable wear ring.

FIG. 5 illustrates an alternative embodiment of the present invention where the non-rotating element is a leakage restricting ring or wear ring 108 that is positioned between a non-rotating, non-adjustable side liner 110 and the impeller 36 near the eye of the impeller 36. An adjustment device 32 is position through the pump casing 54 and is in contact with the wear ring 108. The actuation mechanism 80 of the adjustment device 32 is positioned externally to the pump 12 and is in communication with the control system (not shown). A sensor mechanism 30, such as for example, a vibration sensor 96, is shown in proximity to the adjustment device 32 and is positioned as previously described for detecting a condition, such as increased vibration of the rotating and/or non-rotating elements of the pump. Although a vibration sensor 96 is shown, any other sensor mechanism 30 may be employed as described previously, including a strain gauge.

Figure 6:
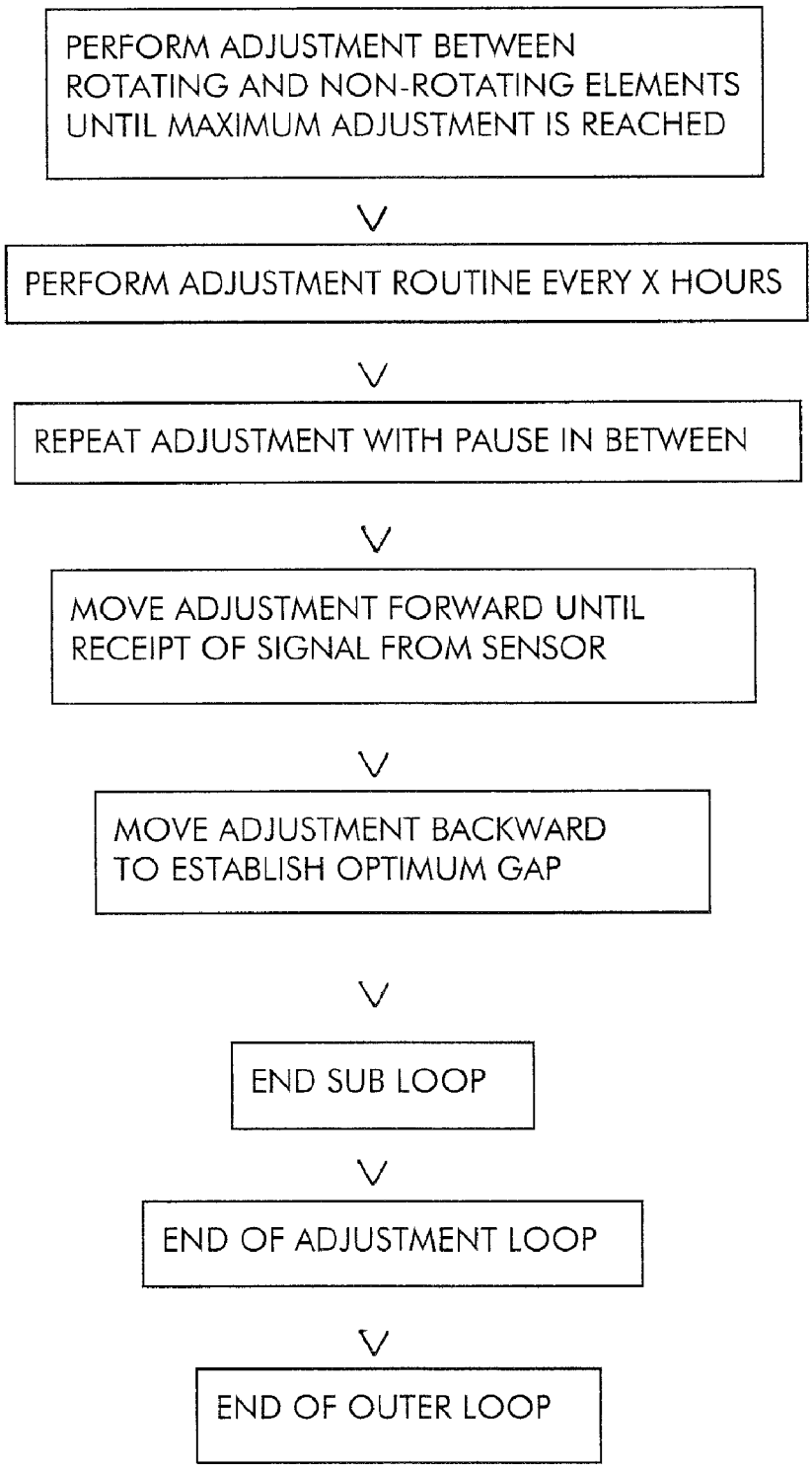
FIG. 6 is a flow diagram schematically illustrating the sequence for actuation of the adjustment devices of the invention.
Figure 7:
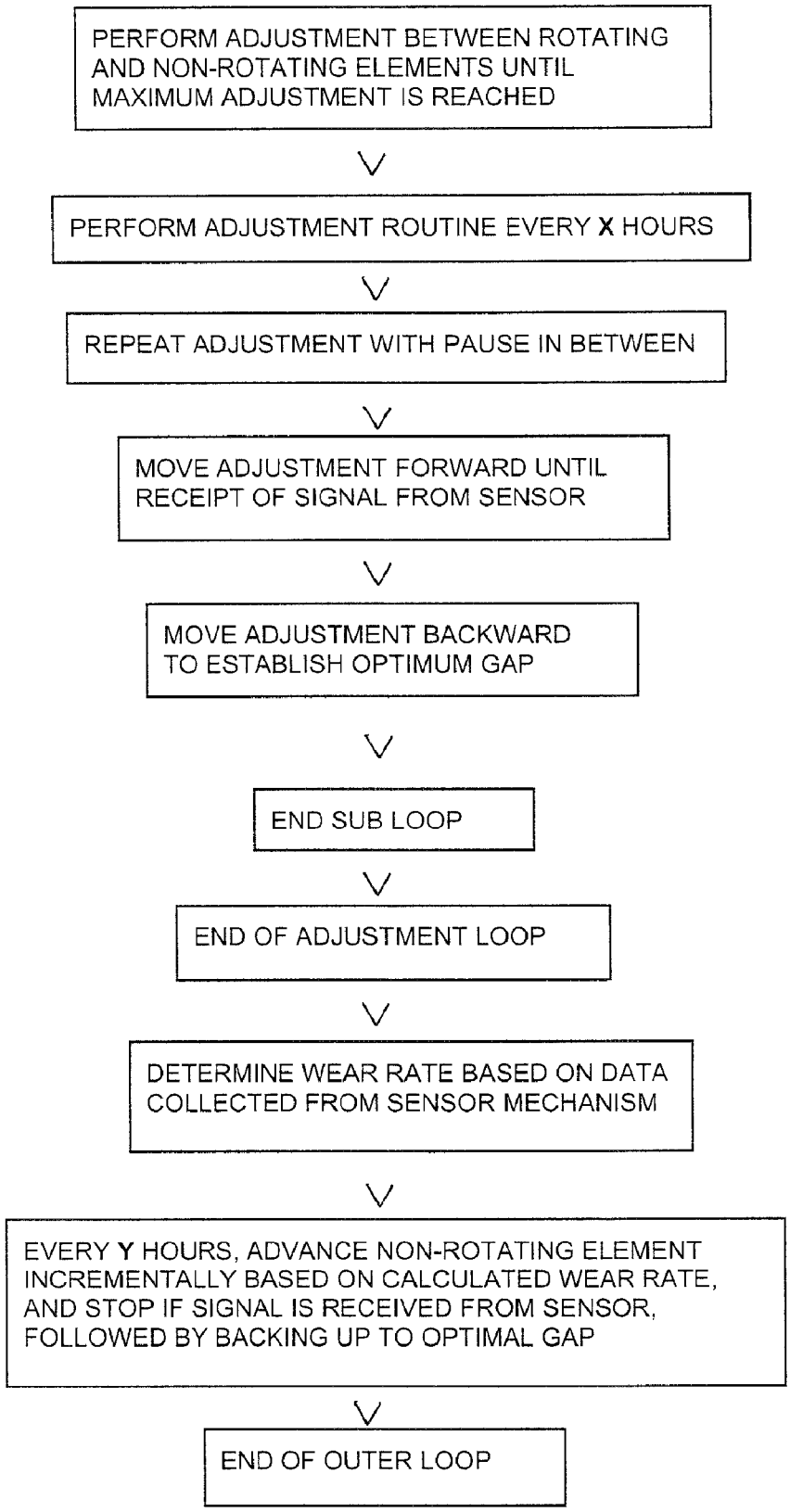
FIG. 7 is a flow diagram schematically illustrating the means for determining predictive adjustments in a pump.

FIG. 6 comprises a schematic flow chart which describes generally how data collected from the sensor mechanisms and the adjustment devices can be processed and stored to provide automatic adjustment and monitoring in the system, as previously described. FIG. 7 is a schematic flow chart of how predictive adjustments, such as may be based on calculated wear rates, may be determined to effect continuous or periodic self-adjustment of the adjustment devices. In the schematic flow charts of both FIGS. 6 and 7, the values X and Y denote selected time periods, where X may typically be greater than Y, and the values or time periods may be based on the particular application to which the pump is placed.

The self-monitoring and adjustment system of the present invention may be installed in or adapted for use in any type of rotodynamic pump, and the system of the invention may be retrofit into existing pumps. Thus, the elements and configurations of the self-monitoring and adjustment system described herein may vary depending on the type of pump and the application. Hence, reference herein to specific details of the invention is by way of example only and is not intended to limit the scope of the invention in any manner.

What is claimed is:

1. A self-adjusting, self-monitoring system for evaluating and effecting adjustment of a leakage restricting mechanism in rotodynamic pumps having a rotating element adjacent a non-rotating element, the system comprising:

at least one adjustment device positioned to effect axial movement between the rotating and non-rotating leakage restricting elements of a pump to provide a selected leakage restricting gap dimension between said rotating and non-rotating elements upon determination of a condition requiring adjustment between said rotating and non-rotating elements;

at least one sensor mechanism positioned to detect conditions of the pump, said at least one sensor being positioned in proximity to said leakage restricting gap between said rotating and non-rotating elements of said pump to determine whether conditions require adjustment of said gap; and a control system in communication with said at least one sensor mechanism and being capable of receiving data from said at least one sensor mechanism to indicate the need for effecting adjustment between the rotating and non-rotating elements of a pump to provide a selected leakage restricting gap dimension therebetween.

2. The self-monitoring system according to claim 1 wherein said control system is further in communication with said at least one adjustment device to signal movement of said at least one adjustment device to effect automatic adjustment between the rotating and non-rotating seal elements of a pump.

3. The self-monitoring system of claim 2 further comprising an actuation mechanism as part of each of said at least one adjustment device which receives a signal from said control system to activate the actuation mechanism to effect movement of said at least one adjustment device.

4. The self-monitoring system of claim 2 wherein said control system includes a processing structure that is capable of processing data received from said at least one sensor mechanism and from said at least one adjustment device to calculate wear rates in the pump, and to use said calculated wear rates to effect automatic adjustment between the rotating and non-rotating elements of the pump.

5. The self-monitoring system of claim 1 wherein said at least one sensor mechanism is a vibration sensor.

6. The self-monitoring system of claim 1 wherein said at least one sensor mechanism is a force sensor.

7. The self-monitoring system of claim 1 wherein said at least one sensor mechanism is a pressure sensor.

8. The self-monitoring system of claim lwherein said at least one sensor mechanism is a torque sensor.

9. A self-adjusting, self-monitoring system for evaluating and effecting adjustment of a leakage restricting mechanism in rotodynamic pumps having a rotating element adjacent a non-rotating element, the system comprising:

at least one adjustment device positioned to effect axial movement between the rotating and non-rotating leakage restricting elements of a pump to provide a selected leakage restricting gap dimension between said rotating and non-rotating elements;

at least one sensor mechanism positioned to detect changes in operational conditions of the drive mechanism of the pump; and a control system in communication with said at least one sensor mechanism and being capable of receiving data from said at least one sensor mechanism to indicate the need for effecting adjustment between the rotating and non-rotating elements of a pump to provide a selected leakage restricting gap dimension therebetween.

10. The self-monitoring system of claim 1 wherein said at least one sensor mechanism is a linear displacement sensor.

11. The self-monitoring system of claim 1 wherein said at least one sensor mechanism is a strain gauge.

12. The self-monitoring system of claim 1 wherein said at least one adjustment device is positioned on the suction side of the pump.

13. The self-monitoring system of claim 12 further including at least one adjustment device positioned on the drive side of the pump.

14. The self-monitoring system of claim 1 wherein said non-rotating leakage restricting element of said pump is a wear plate.

15. The self-monitoring system of claim 1 wherein said non-rotating leakage restricting element of said pump is a wear ring.

16. The self-monitoring system of claim 1 wherein said at least one sensor comprises a plurality of sensor selected from the group consisting of linear displacement sensors, amp detectors, vibration sensors, force sensors, pressure sensors, strain gauges and torque sensors, and combinations of those sensors.

17. A self-monitoring system for effecting adjustment of a leakage restricting mechanism in rotodynamic pumps having a rotating element adjacent a non-rotating element, comprising:

at least one adjustment device positioned to effect axial movement between the rotating and non-rotating leakage restricting elements of a pump to provide a selected leakage restricting gap dimension between said rotating and non-rotating elements; and at least one sensor mechanism positioned to detect conditions of the pump at said gap between said rotating and non-rotating elements to determine the adjustment requirements of said gap dimensions therebetween, said at least one sensor mechanism being structured to provide an indication of pump conditions or the relative position between said rotating and non-rotating elements of the pump from which a determination can be made to manually adjust said at least one adjustment device to provide a selected leakage restricting gap dimension between said rotating and non-rotating elements.

18. The self-monitoring system of claim 17 further comprising a control system in communication with said at least one sensor mechanism, said control system having an alarm device that provides notice of a determination that manual adjustment is required between said rotating and non-rotating elements of the pump.

19. A method of providing self-monitoring and self-adjustment of leakage restricting elements in rotodynamic pumps having adjacent rotating and non-rotating elements, comprising:

providing a self-monitoring and self-adjusting system comprising:

at least one adjustment device positioned to effect axial movement between the rotating and non-rotating leakage restricting elements of a pump to provide a selected leakage restricting qap dimension between said rotating and non-rotating elements;

at least one sensor mechanism positioned in proximity to said leakage restricting gap to detect conditions of the pump which determine whether actuation of said adjustment device is required to provide said operational gap; and a control system in communication with said at least one sensor mechanism and being capable of receiving data from said at least one sensor mechanism to indicate the need for effecting adjustment between the rotating and non-rotating elements of a pump;

detecting a condition of a pump via said at least one sensor mechanism;

sending a signal from said at least one sensor mechanism to said control system upon detection of said condition;

evaluating the condition of the pump using the control system; and sending a signal from the control system to said at least one adjustment device to effect an adjustment between the rotating and non-rotating elements of the pump.

20. The self-monitoring system of claim 9 wherein said at least one sensor mechanism is an amp detector in communication with a drive motor of a pump.

21. The self-monitoring system of claim 9 wherein said at least one sensor mechanism is a torque sensor.

22. A method of providing self-monitoring and self-adjustment of leakage restricting elements in rotodynamic pumps having adjacent rotating and non-rotating elements, comprising:

providing a self-monitoring and self-adjusting system comprising:

at least one adjustment device positioned to effect axial movement between the rotating and non-rotating leakage restricting elements of a pump to provide a selected leakage restricting gap dimension between said rotating and non-rotating elements;

at least one sensor mechanism positioned to detect conditions of a drive mechanism of the pump to detect conditions which warrant actuation of at least one adjustment device to provide a selected leakage restricting gap dimension between rotating and non-rotating elements of the pump; and a control system in communication with said at least one sensor mechanism and being capable of receiving data from said at least one sensor mechanism to indicate the need for effecting adjustment between the rotating and non-rotating elements of a pump;

detecting a condition of a pump via said at least one sensor mechanism;

sending a signal from said at least one sensor mechanism to said control system upon detection of said condition;

evaluating the condition of the pump using the control system; and sending a signal from the control system to said at least one adjustment device to effect an adjustment between the rotating and non-rotating elements of the pump.

* * * * *